US012453433B2

(12) United States Patent
Rebecchi

(10) Patent No.: US 12,453,433 B2
(45) Date of Patent: Oct. 28, 2025

(54) ICE BUCKET

(71) Applicant: Samuele Rebecchi, Castiglione Delle Stiviere (IT)

(72) Inventor: Samuele Rebecchi, Castiglione Delle Stiviere (IT)

( * ) Notice: Subject to any disclaimer, the term of this patent is extended or adjusted under 35 U.S.C. 154(b) by 0 days.

(21) Appl. No.: 18/833,193

(22) PCT Filed: Jan. 25, 2023

(86) PCT No.: PCT/IT2023/050020

§ 371 (c)(1),
(2) Date: Jul. 25, 2024

(87) PCT Pub. No.: WO2023/144850

PCT Pub. Date: Aug. 3, 2023

(65) Prior Publication Data

US 2025/0127319 A1 Apr. 24, 2025

(30) Foreign Application Priority Data

Jan. 28, 2022 (IT) ..... 102022000001439

(51) Int. Cl.

| | |
|---|---|
| ***A47G 23/02*** | (2006.01) |
| ***A47G 23/08*** | (2006.01) |
| ***F25D 3/08*** | (2006.01) |

(52) U.S. Cl.

CPC ..... *A47G 23/0241* (2013.01); *A47G 23/08* (2013.01); *F25D 3/08* (2013.01); *A47G 2200/08* (2013.01); *F25D 2303/081* (2013.01); *F25D 2331/803* (2013.01)

(58) Field of Classification Search

CPC ..... A47G 23/0241; A47G 23/08; A47G 2200/08; F25D 3/08; F25D 2303/081; F25D 2331/803

See application file for complete search history.

(56) References Cited

U.S. PATENT DOCUMENTS

| | | | | |
|---|---|---|---|---|
| 225,143 A * | 3/1880 | Kahler | ..... | A47G 19/24 220/253 |
| 469,216 A * | 2/1892 | Quinn | ..... | A47F 5/0037 248/225.11 |
| 1,728,512 A * | 9/1929 | Sharp | ..... | A47F 5/0037 126/246 |

(Continued)

FOREIGN PATENT DOCUMENTS

| | | |
|---|---|---|
| DE | 20205030 U1 | 7/2002 |
| FR | 2991492 A1 | 12/2013 |

(Continued)

OTHER PUBLICATIONS

International Search Report and Written Opinion of the ISA for PCT/IT2023/050020, mailed May 3, 2023, 10 pages.

*Primary Examiner* — Ko H Chan
(74) *Attorney, Agent, or Firm* — NIXON & VANDERHYE

(57) ABSTRACT

The invention relates to an ice bucket (1) comprising: a base (2) for resting on a surface; a central body (3); a plurality of tanks (4), associable with said central body (3), adapted to contain ice and bottles to be refrigerated; means for the rotatable connection between said central body (3) and said base (2) to allow the rotation of said tanks (4) and selectively make said bottles available to a plurality of users.

7 Claims, 3 Drawing Sheets

(56) References Cited

U.S. PATENT DOCUMENTS

| | | | | |
|---|---|---|---|---|
| 3,417,873 | A * | 12/1968 | Leptrone | B67D 3/0022 312/97.1 |
| 5,782,359 | A * | 7/1998 | McAllister | B65D 41/06 206/1.5 |
| 6,705,109 | B2 | 3/2004 | Demars | |
| 7,156,226 | B1 * | 1/2007 | Van Sickle | A47J 47/16 206/1.5 |
| 8,302,787 | B2 * | 11/2012 | Tobey | A61J 1/16 211/77 |
| 8,915,391 | B2 * | 12/2014 | Radow | A47G 19/00 211/144 |
| 9,888,800 | B2 | 2/2018 | Mueller et al. | |
| 10,099,098 | B2 * | 10/2018 | Snyder | A63B 55/10 |
| 10,442,592 | B2 * | 10/2019 | Afif | B65D 55/14 |
| 11,191,702 | B2 * | 12/2021 | Zonana | A61J 7/0084 |
| 11,365,037 | B2 * | 6/2022 | Afif | A61J 1/03 |
| 11,565,851 | B2 * | 1/2023 | Grella | B25G 1/102 |
| 2002/0170868 | A1 * | 11/2002 | Morgan | A47G 23/08 211/163 |
| 2005/0005631 | A1 | 1/2005 | Demars | |
| 2005/0072711 | A1 * | 4/2005 | Yang | F25D 3/08 206/499 |
| 2008/0011697 | A1 | 1/2008 | Berg | |
| 2008/0156811 | A1 | 7/2008 | Lu et al. | |
| 2015/0345776 | A1 | 12/2015 | Brandon, Jr. | |

FOREIGN PATENT DOCUMENTS

| | | | |
|---|---|---|---|
| GB | 1122315 | A | 8/1968 |
| JP | H09168466 | A | 6/1997 |

* cited by examiner

ICE BUCKET

CROSS-REFERENCE TO RELATED APPLICATIONS

This application is the U.S. national phase of International Application No. PCT/IT2023/050020 filed Jan. 25, 2023, which designated the U.S. and claims priority to IT 102022000001439 filed Jan. 28, 2022, the entire contents of each of which are hereby incorporated by reference.

TECHNICAL FIELD OF APPLICATION

The present invention relates to a thermal container intended in particular for cooling bottled beverages.

In particular, the invention relates to an ice bucket.

BACKGROUND ART

Traditional containers or buckets are known in the art intended to contain ice, or a mixture of water and ice, adapted to cool one or more bottles of beverages arranged inside them by conduction.

An example of such containers is the classic and well-known ice bucket for bottles of wine, sparkling wine or champagne.

Traditional ice buckets have a single bowl and, if of adequate size, they can also contain several different bottles.

These ice buckets are normally used on bar counters with bottles of wine and spirits inside, available to the bartender for the preparation of aperitifs and cocktails, or on the drinks table for refreshments available to the waiters.

On the occasion of banquets and ceremonies, it is not uncommon instead to see ice buckets placed on the tables directly available to diners with several bottles of different wines and sparkling wines to match the different courses.

If on the one hand these ice buckets are roomy and can advantageously contain several bottles, on the other hand they do not offer convenient access for the same to the users: a bucket placed in the centre of the table does not allow all the diners to easily take all the bottles.

Similarly, on the bar counter, the bottles often slip into the bucket and hide from the sight of the bartender who struggles to remove them.

DISCLOSURE OF THE INVENTION

The object of the present invention is to provide a roomy and easy-to-use ice bucket, adapted to accommodate a plurality of bottles, and above all offering easy access to all the bottles contained.

The objects are achieved with an ice bucket characterized in that it comprises:

- a base for resting on a surface;
- a central body;
- a plurality of tanks, associable with said central body, adapted to contain ice and bottles to be refrigerated;
- means for the rotatable connection between said central body and said base to allow the rotation of said tanks and selectively make said bottles available to a plurality of users.

According to a first aspect of the invention, said rotatable connection means comprise at least one radial bearing interposed between said base and said central body.

In a preferred embodiment variant, said ice bucket comprises means for reversible association, of the shape-coupling type, of said tanks to said central body.

Preferably, said reversible association means comprise channels uniformly distributed on said central body and corresponding tracks, each provided on one of said tanks, where said channels and said tracks cooperate to keep the association of said tanks to said central body stable during the rotation of the latter on said base.

Advantageously, said reversible association means comprise a fork provided with elastic plates adapted to fit on said central body and said tanks for keeping said tracks and said channels coupled to avoid the escape thereof.

According to a further aspect of the invention, said ice bucket comprises a disc structure stably associated with said central body, comprising a plurality of arms extending radially from it, where each arm is adapted to support one of said tanks.

According to a preferred aspect of the invention, said tanks comprise a translucent or transparent plastic material.

Advantageously, said arms comprise a housing for LEDs for the backlighting of said tanks.

Furthermore, said ice bucket comprises an electrical power supply system for said LEDs comprising power supply batteries, a switch and electrical connection cables, and said central body comprises a cavity adapted to house said batteries and a closing door for said cavity.

In a particularly preferred variant, said ice bucket comprises accessory elements and corresponding fastening means of the latter to the top of said central body.

The invention has numerous advantages.

- by virtue of the rotatable connection means, the tanks rotate together with the central body on the base, allowing the bottles to assume different positions that are more comfortable for the grip of the users who do not have to move around the bucket, or the table on which it is placed, or reach out to grab the furthest bottle;
- the reversible association means of the tanks to the central body make said tanks interchangeable and washable separately from the central body;
- being able to manage the tanks separately also makes the ice bucket more manageable, its filling more convenient, and the replacement of bottles when empty more practical;
- the shape coupling fastening means and the fork make the association of the tanks to the central body stable during use, without the risk of disengagement or slipping;
- the disc structure offers rest and greater support to the tanks when, in addition to containing the bottles, they are full of ice;
- the LEDs backlight the transparent or translucent material of the tanks creating a pleasant scenographic effect;
- the fastening means for any accessory elements offer the possibility for said ice bucket to perform further functions, both decorative but also of support, for example for trays or bowls containing food or snacks.

BRIEF DESCRIPTION OF THE DRAWINGS

These and other features and advantages of the invention will become apparent from the more detailed description set forth below, with the aid of the drawings which show a preferred embodiment thereof, illustrated by way of non-limiting example, in which.

DETAILED DESCRIPTION OF A PREFERRED EMBODIMENT OF THE INVENTION

Figure 1:
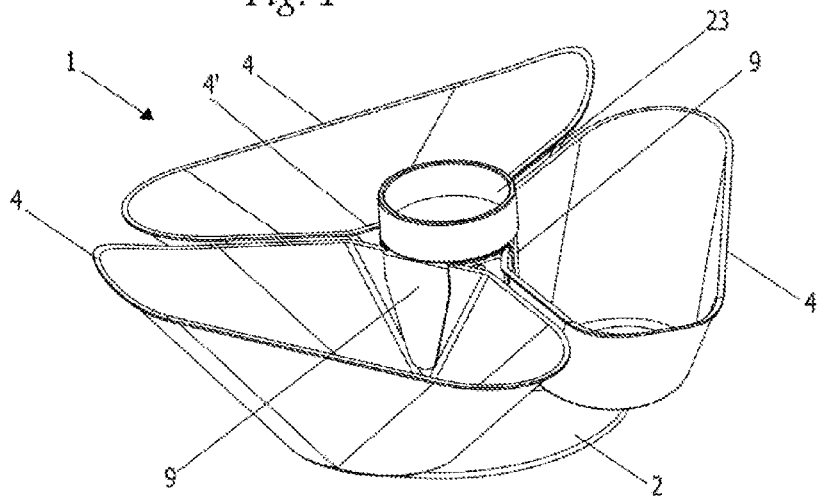
FIGS. 1 and 2 show, in assembled and exploded isometric view respectively, an ice bucket according to the invention.
Figure 3:
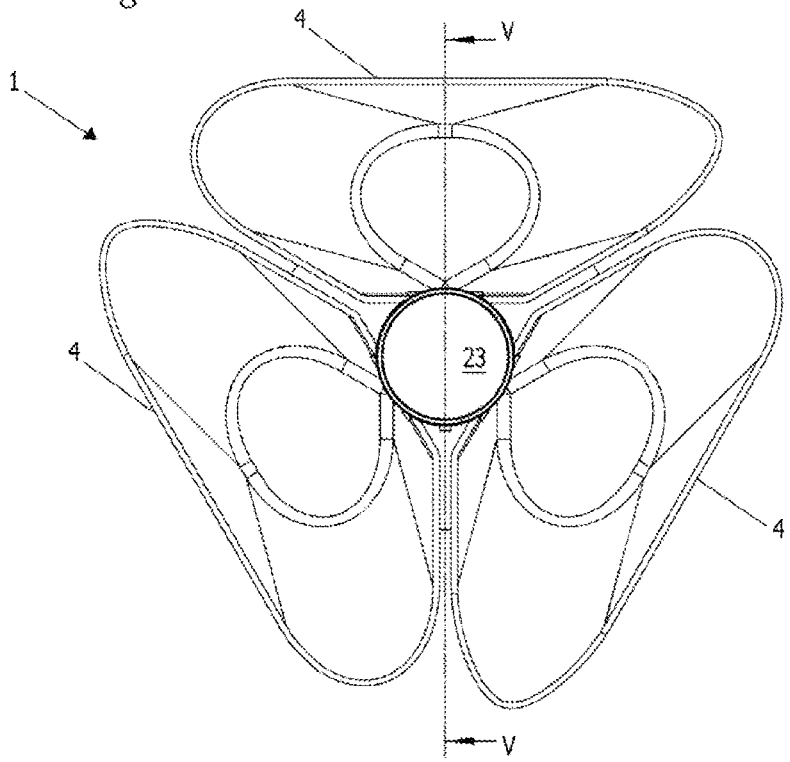
FIGS. 3, 4 and 5 show, in plan view from above, in side view and in section along a vertical plane, respectively, the ice bucket of FIG. 1.

With reference to the figures, an ice bucket 1 for containing bottles of sparkling wine, wine, water or beverages in general which need to be kept cool is illustrated.

Said ice bucket 1 essentially comprises:

a base 2 for resting on a surface;

a central body 3;

a plurality of tanks 4, associable with said central body 3, adapted to contain ice and bottles to be refrigerated (not shown);

rotatable connection means between said central body 3 and said base 2.

Said rotatable connection means comprise at least one radial bearing 5, advantageously two radial bearings 5 superimposed on each other and interposed between said base 2 and said central body 3.

Said radial bearings 5 allow rotation on the base 2 of the central body 3, and of the tanks 4 associated with it, to make said bottles selectively available to a plurality of users arranged around the ice bucket 1.

In the variant illustrated, said central body 3 has a substantially cylindrical shape, comprises a lower base 3*a* facing said base 2, an upper base 3*b* and a side surface comprising a plurality of flat faces 3*c* available for the association of the tanks 4.

The tanks 4 in particular are three in number, uniformly distributed around said central body 3 and comprise flat side walls 4' adapted to cooperate in support on said flat faces 3*c*.

The tanks 4 are advantageously made of transparent or translucent plastic material, to allow the contents and the particular bottle inside to be seen, and are shaped to accommodate different bottle formats.

Advantageously said tanks 4 can be interchangeable, by selecting them for example of a suitable shape according to the bottles to be contained and the inclined or vertical position.

For this purpose, said ice bucket 1 comprises means for reversible association, of the shape-coupling type, of said tanks 4 to said central body 3.

Figure 2:
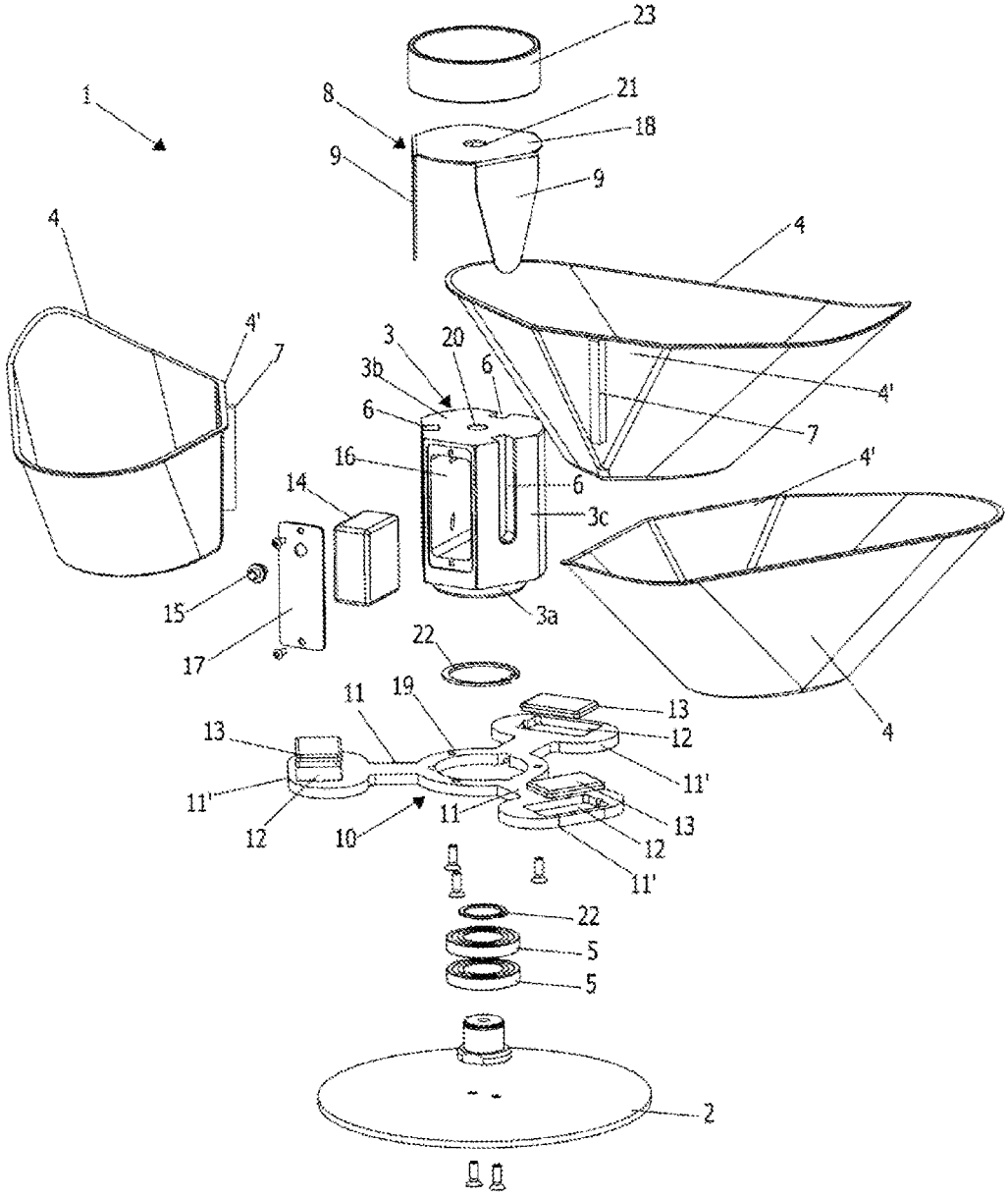
Figure 4:
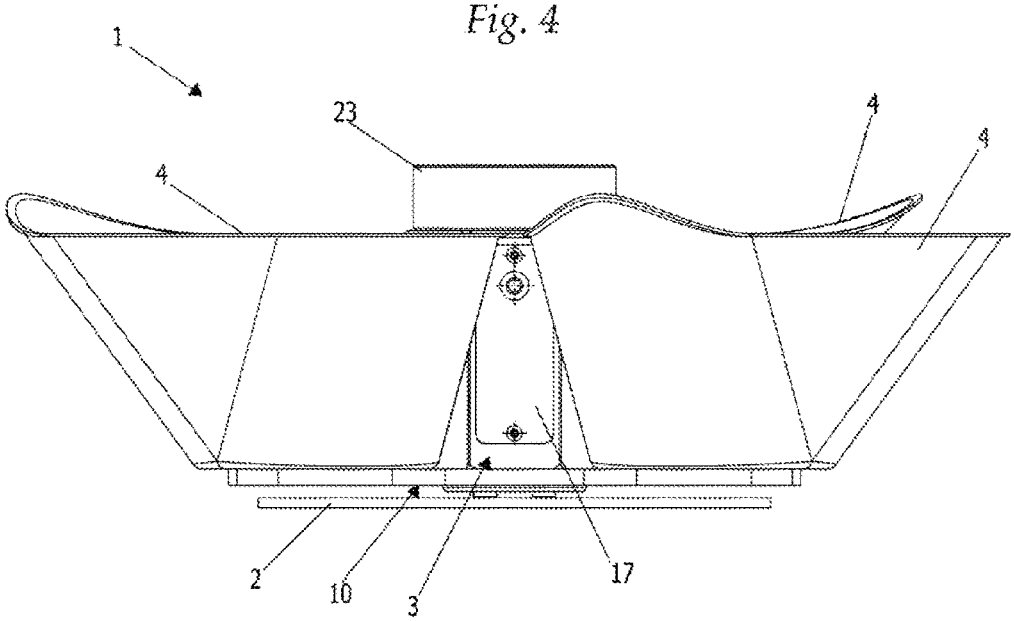
Figure 5:
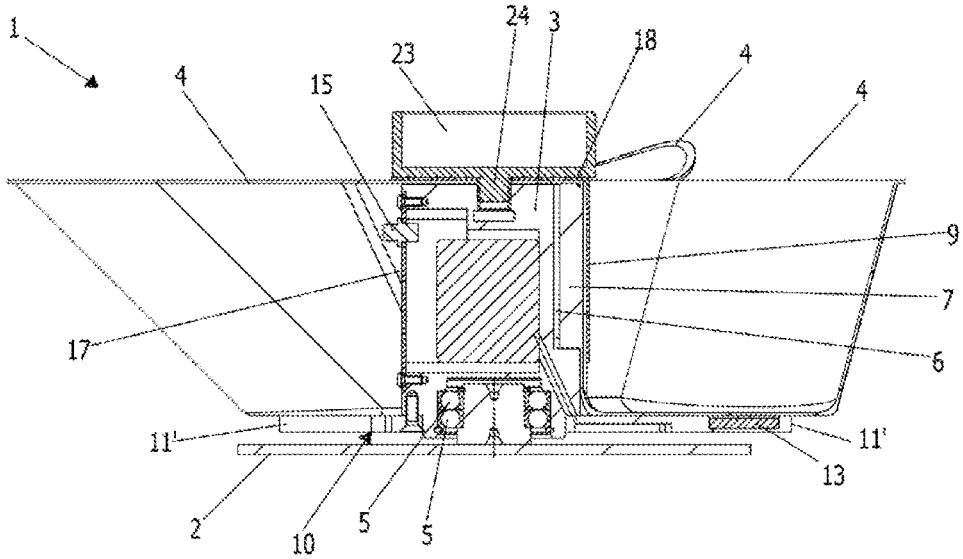

As particularly evident from the exploded view of FIG. 2, said reversible association means comprise three channels 6 uniformly distributed on the side surface 3*c* of said central body 3 and three corresponding tracks 7, each track 7 provided on one of said tanks 4, projecting externally from its flat side wall 4'.

The sections of said channels 6 and said tracks 7 are complementary and ensure a stable coupling between the central body 3 and the tanks 4, avoiding their disconnection in the tangential direction particularly during the rotation of the central body 3 on the base 2.

Again for the purpose of best securing the tanks 4 to the central body 3, avoiding their radial disengagement also due to the increased weight brought about by the ice and the bottles contained, said reversible association means comprise a safety fork 8.

Said fork 8 is provided with a circular plate 18 and radial elastic plates 9 projecting orthogonally from said plate 18. Said elastic plates 9 are equal in number to the tanks 4, and therefore three, equidistant from each other.

Said fork 8 is adapted to fit on said central body 3, with the circular plate 18 resting on the upper base 3*b* of said central body 3 and with the elastic plates 9 inside said tanks 4 against the flat side walls 4', to maintain coupled said tracks 7 and said channels 6 and precisely avoiding the disengagement thereof.

Since said tanks 4 can be heavy when full of ice and bottles, said ice bucket 1 comprises a support disc structure 10.

Said disk structure 10 comprises a ring 19 stably associated, by means of screws, with said central body 3, and a plurality of arms 11 which extend radially from said ring 19, where each arm 11 is shaped at its free end 11' to support one of said tanks 4.

Each arm 11, at its free end 11' on which the tank 4 will rest, comprises a housing 12 for backlighting LEDs 13 of the corresponding tank 4.

The presence of LEDs 13 creates, with the help of the ice and the glass of the bottles, a particular play of light and reflections which makes the ice bucket 1 captivating and very scenographic.

For the operation of said LEDs 13, said ice bucket 1 comprises an electrical power supply system comprising power supply batteries 14, a switch 15 and electrical connection cables (not shown).

Said power batteries 14 are housed in a cavity 16 obtained in said central body 3 and closed by a door 17.

A plurality of Seeger ring connection means 22 are provided between said bearings 5, said bracket 10, said central body 3.

In a preferred variant, said ice bucket 1 can comprise at least one accessory element 23 to be fixed on the top of said central body 3.

For this purpose, said ice bucket 1 comprises fastening means for said possible accessory element 23.

In particular, the upper base 3*b* of said central body 3 comprises a threaded hole 20, and the circular plate 18 of said fork 8 comprises a hole 21, for the passage of a screw stem 24 protruding from said accessory element 23, adapted to allow the accessory element 23 to be tightened on the ice bucket 1.

Said accessory element 23 can advantageously be a support tray for glasses or snacks, or a vase of flowers, a candle holder, etc. . . . .

The invention claimed is:

1. An ice bucket comprising:

a base configured to rest on a surface;

a central body;

a plurality of tanks, associable with said central body, adapted to contain ice and bottles to be refrigerated;

means for a rotatable connection between said central body and said base to allow rotation of said tanks and selectively make said bottles available to a plurality of users; and means for reversible association, of a shape-coupling type, of said tanks to said central body, the reversible association means comprising:

channels uniformly distributed on said central body;

corresponding tracks, each provided on one of said tanks, wherein said channels and said tracks cooperate to keep the association of said tanks to said central body stable during the rotation of the central body on said base; and a fork provided with elastic plates configured to fit simultaneously on said central body and said tanks so as to keep said tracks and said channels coupled to avoid escape of the tracks from the channels.

2. The ice bucket according to claim 1, wherein said rotatable connection means further comprises at least one radial bearing interposed between said base and said central body.

3. The ice bucket according to claim 1, wherein said tanks comprise a translucent or transparent plastic material.

4. An ice bucket comprising:

a base configured to rest on a surface;

a central body;

a plurality of tanks, associable with said central body, adapted to contain ice and bottles to be refrigerated;

means for rotatable connection between said central body and said base to allow rotation of said tanks and selectively make said bottles available to a plurality of users; and a disc structure stably associated with said central body, comprising a plurality of radially extending arms, each said arm being configured to support one of said tanks, said arms comprising a housing for LEDs configured to backlight of said tanks.

5. The ice bucket according to claim 4, further comprising an electrical power supply system for said LEDs comprising:

power supply batteries;

a switch; and electrical connection cables.

6. The ice bucket according to claim 5, wherein said central body comprises a cavity configured to house said power supply batteries and a closing door for said cavity.

7. The ice bucket according to claim 1, further comprising:

accessory elements; and corresponding fastening means of the accessory elements to a top of said central body.

* * * * *